US005344495A

United States Patent [19]

Yanai et al.

[11] Patent Number: 5,344,495

[45] Date of Patent: Sep. 6, 1994

[54] PROCESS OF CLEANING A PANEL IN THE MANUFACTURE OF A CATHODE RAY TUBE

[75] Inventors: Kunihiko Yanai; Kosaku Suzuki, both of Aichi, Japan

[73] Assignee: Sony Corporation, Tokyo, Japan

[21] Appl. No.: 75,866

[22] Filed: Jun. 11, 1993

Related U.S. Application Data

[63] Continuation of Ser. No. 765,054, Sep. 24, 1991, abandoned.

[30] Foreign Application Priority Data

Sep. 25, 1990 [JP] Japan ..... 2-254781

[51] Int. Cl.[5] ..... B08B 3/02; B08B 3/04; B08B 9/00; B08B 9/093

[52] U.S. Cl. ..... 134/22.1; 134/22.12; 134/22.18; 134/24; 134/25.4

[58] Field of Search ..... 134/22.12, 22.18, 24, 134/25.4, 22.1

[56] References Cited

U.S. PATENT DOCUMENTS 5,135,420 8/1992 Sumi et al. ..... 134/22.18

FOREIGN PATENT DOCUMENTS 0131336 6/1986 Japan ..... 445/59

*Primary Examiner*—R. Bruce Breneman
*Assistant Examiner*—Zeinab El-Arini
*Attorney, Agent, or Firm*—Hill, Steadman & Simpson

[57] ABSTRACT

A method of for developing a panel in manufacture of a cathode ray tube which prevents possible dispersion of developing liquid to achieve a good developing operation free from irregular development. The method comprises fixing a panel, jetting developing liquid by way of a nozzle toward an inner face of the panel while moving the nozzle in a direction along stripes of a fluorescent face to be formed on the inner face of the panel to perform development of the panel.

8 Claims, 4 Drawing Sheets

PROCESS OF CLEANING A PANEL IN THE MANUFACTURE OF A CATHODE RAY TUBE

This is a continuation of application Ser. No. 07/765,054, filed Sep. 24, 1991, now abandoned.

BACKGROUND OF THE INVENTION

1. Field of the Invention

This invention relates to a process of manufacturing a cathode ray tube, and more particularly to a developing method during formation of a fluorescent face in manufacture of a cathode ray tube.

2. Description of the Prior Art

In formation of a fluorescent face in manufacture of a color cathode ray tube, exposure to light and development, for example, of a PVA (polyvinyl alcohol) photosensitive film, an applied film of carbon slurry or color fluorescent slurry are performed.

A developing operation for an applied film on an inner face of a panel after an exposure operation is performed by jetting developing liquid toward an inner face of a panel by way of a nozzle while rotating the panel.

In such conventional developing operation, since developing liquid is jetted toward a rotating panel by way of a nozzle, such developing liquid is possible dispersed around the panel so that it adheres to a clamping apparatus which clamps the panel thereon or to another panel at a following step and so forth and accordingly has a bad influence on various elements around the panel.

SUMMARY OF THE INVENTION

It is an object of the present invention to provide a process of manufacturing a cathode ray tube which prevents possible dispersion of developing liquid to achieve a good developing operation free from irregular development.

In order to attain the object, according to the present invention, there is provided a method of cleaning a panel in manufacture of a cathode ray tube, which comprises the steps of fixing a panel at a predetermined position, and jetting developing liquid by way of a nozzle toward an inner face of the panel while moving the nozzle in a direction along stripes of a fluorescent face to be formed on the inner face of the panel to perform development of the panel.

With the method, since the nozzle for jetting developing liquid is moved in the direction with a panel held in a fixed condition to perform development of the panel, otherwise possible dispersion of developing liquid around the panel is restricted. Accordingly, a possible bad influence of such developing liquid to any other element around the panel can be prevented and a high reliability in the manufacturing process can be assured. Further, since the nozzle is moved in the direction alone stripes of a fluorescent face to be formed in an inner face of the panel, food development free from irregular development can be achieved. Accordingly, for example, a color fluorescent face of a fine pattern can be produced with a high degree of accuracy.

According to another aspect of the present invention, there is provided an apparatus for cleaning a panel in manufacture of a cathode ray tube, which comprises a vessel having an opening at one side thereof, a mask resiliently supported in the vessel and having an opening formed therein, means for removably mounting a panel in a fixed condition on a substantially vertical face of the mask adjacent the opening of the vessel in the vessel such that stripes of a fluorescent face to be formed on an inner face of the panel extend in upward and downward directions and a seal end face of the panel contacts closely with the face of the mask, a nozzle mounted for movement in the upward and downward directions adjacent and in parallel to the other face of the mask and having a plurality of nozzle elements provided in a horizontal row thereon in an opposing relationship to the opening of the mask for jetting developing liquid toward the inner face of the panel, and means for supplying developing liquid to the nozzle.

With the apparatus, such effects as achieved by the method described above can be achieved similarly.

Preferably, the apparatus further comprises a resilient element provided at a location of the mask at which the mask contacts with the seal end face of the panel in order to assure closer contact between the mask and the seal end face of the panel. The means for removably mounting preferably includes positioning means for fixing the position of the panel relative to the mask.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
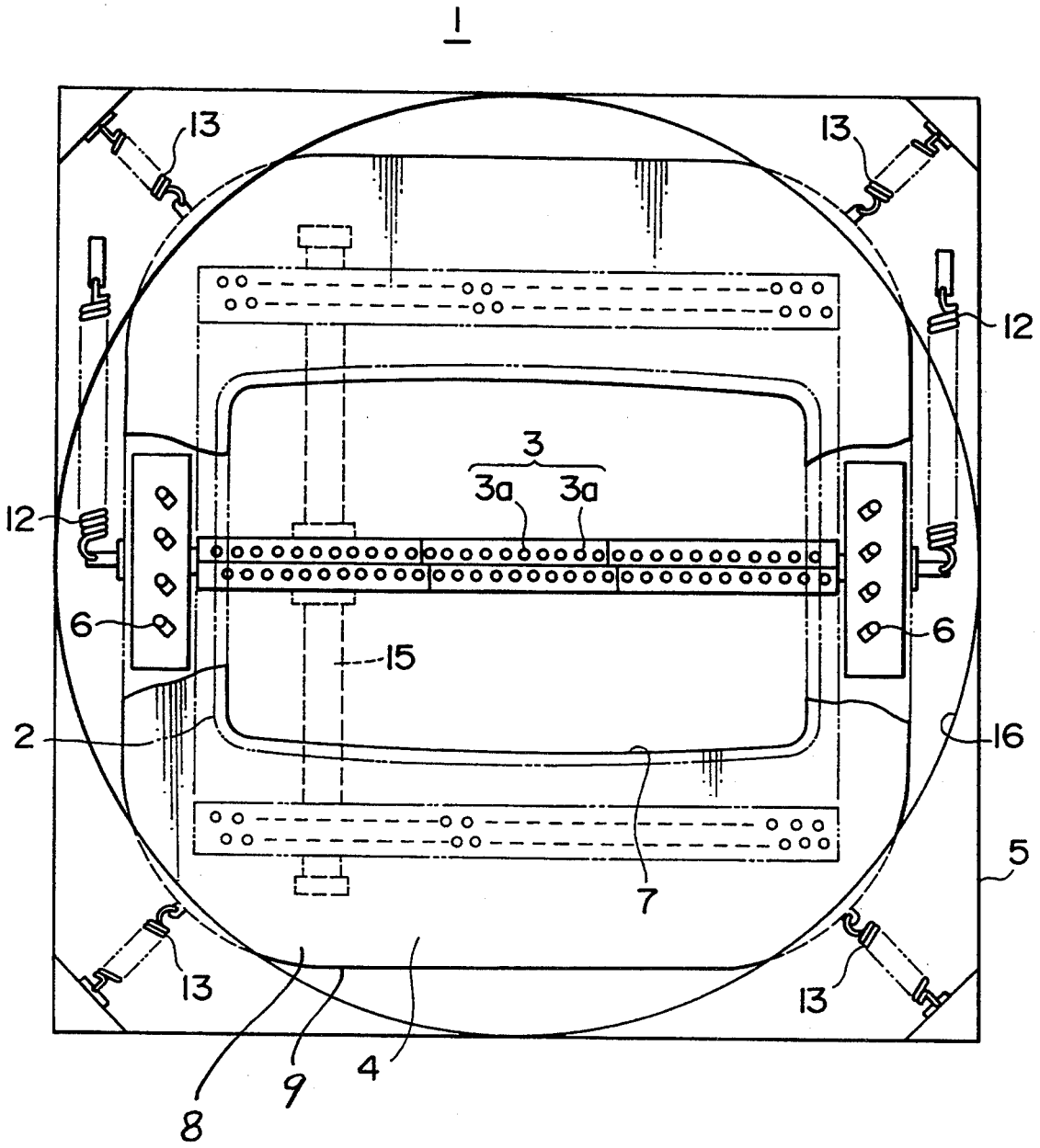
FIG. 1 is a plan view of a developing apparatus for use for a process of manufacturing a cathode ray tube according to the present invention.

In order to facilitate understanding of the present invention, an exemplary process of forming a color fluorescent face of a color cathode ray tube will be described first, PVP (polyvinyl pyrolidone) photosensitive liquid is poured into an inner face of a panel for a cathode ray tube to form a PVP photosensitive film of a uniform film thickness. Then, after the PVP photosensitive film is dried, it is exposed to light using color selecting electrodes as an optical mask, and then a developing operation is performed by washing of the inner face of the panel with water to form resist layers in the form of stripes at locations corresponding to individual colors. Subsequently, carbon slurry is poured to the entire inner face of the panel including the resist layers to form a uniform applied film of carbon. Then, after the applied carbon film Is dried, a reversing agent such as, for example, hydrogen peroxide is poured into the panel to dissolve the resist layers, and then reversal development is performed by washing of the inner face of the panel with water (that is, to lift off the resist layers together with the applied carbon films thereon) to form carbon stripes, that is, black stripes of s predetermined pattern. Subsequently, PVA (polyvinyl alcohol) photosensitive liquid is poured into the panel to form a PVA photosensitive film of a uniform film thickness, and then, after the PVA photosensitive film is dried, exposure to light corresponding to two colors of, for example, red and blue is performed using the color selecting electrodes as an optical mask. Then, a developing operation is performed by washing with water to form resist layers at portions corresponding to the two colors of red and blue. After then, slurry of a fluorescent substance of green is applied, and after such slurry is dried, outer face exposure is performed from forwardly of a front face of the panel. Then, a reversing agent such as, for example, hydrogen peroxide is poured into the panel to dissolve the resist layers, and then reversal development is performed by washing with water (that is, to lift off the resist layers together with the applied fluorescent slurry films thereon) to form stripes of the green fluorescent substance at positions between predetermined ones of the carbon stripes. After then, stripes of a red fluorescent substance and stripes of a blue fluorescent substance are successively formed in a similar manner at locations between other respective predetermined ones of the carbon strips. Subsequently, warm water is poured into the panel to raise the temperature of the panel, and then an intermediate film (primal) is formed, whereafter a metal back of aluminum is formed, thereby obtaining an object color fluorescent face.

A developing method in manufacture of a cathode ray tube according to the present invention can be applied to a developing operation by washing with water of a PVP photosensitive film or a PVA photosensitive film at such fluorescent face forming process as described above and also to a reversal developing operation by washing with water of an applied carbon slurry film or an applied fluorescent substance slurry film.

In the following, an embodiment of a developing method according to the present invention will be described in connection with a developing apparatus shown in FIGS. 1 to 3.

Figure 2:
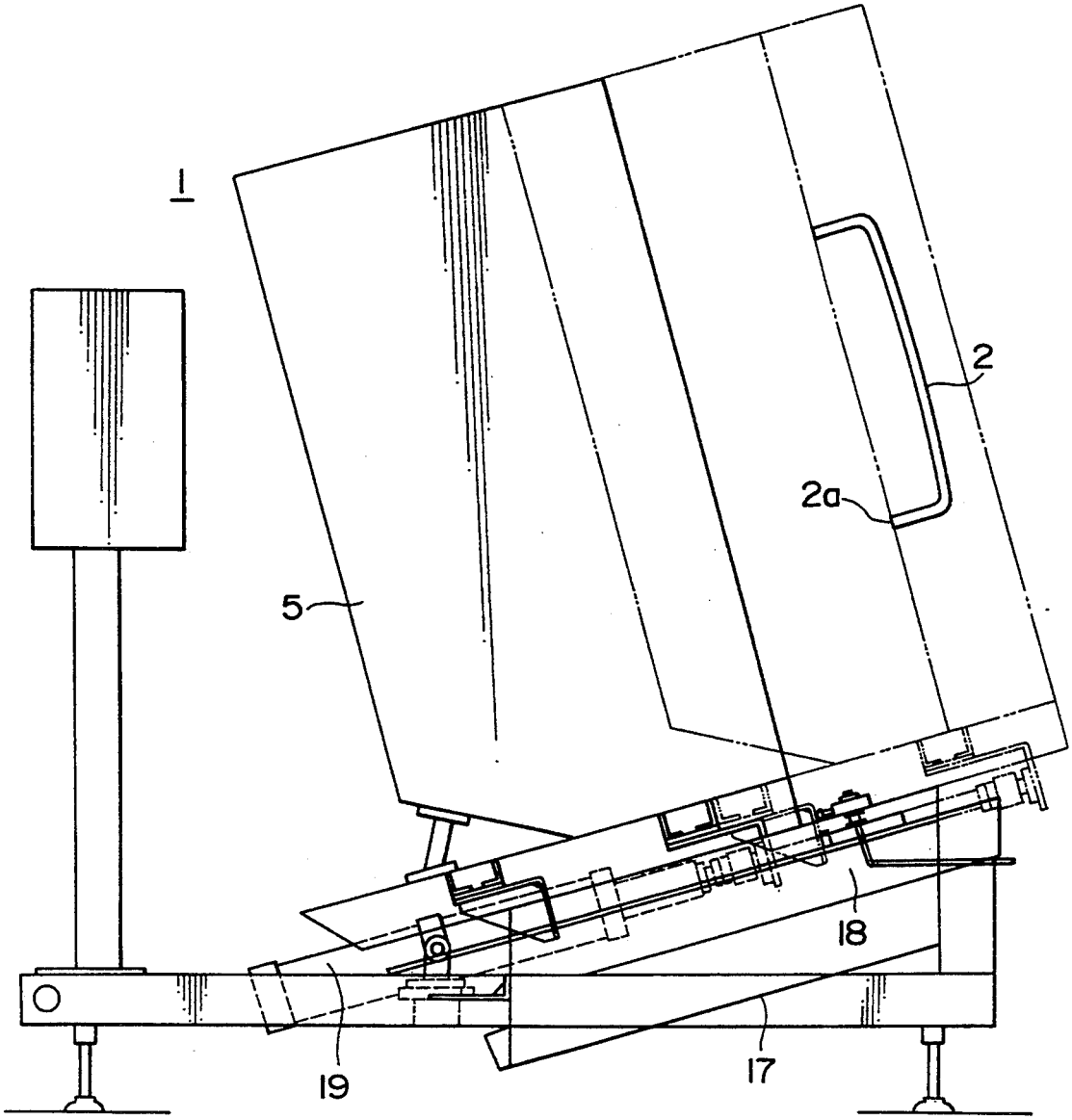
FIG. 2 is a side elevational view of the developing apparatus of FIG. 1.
Figure 3:
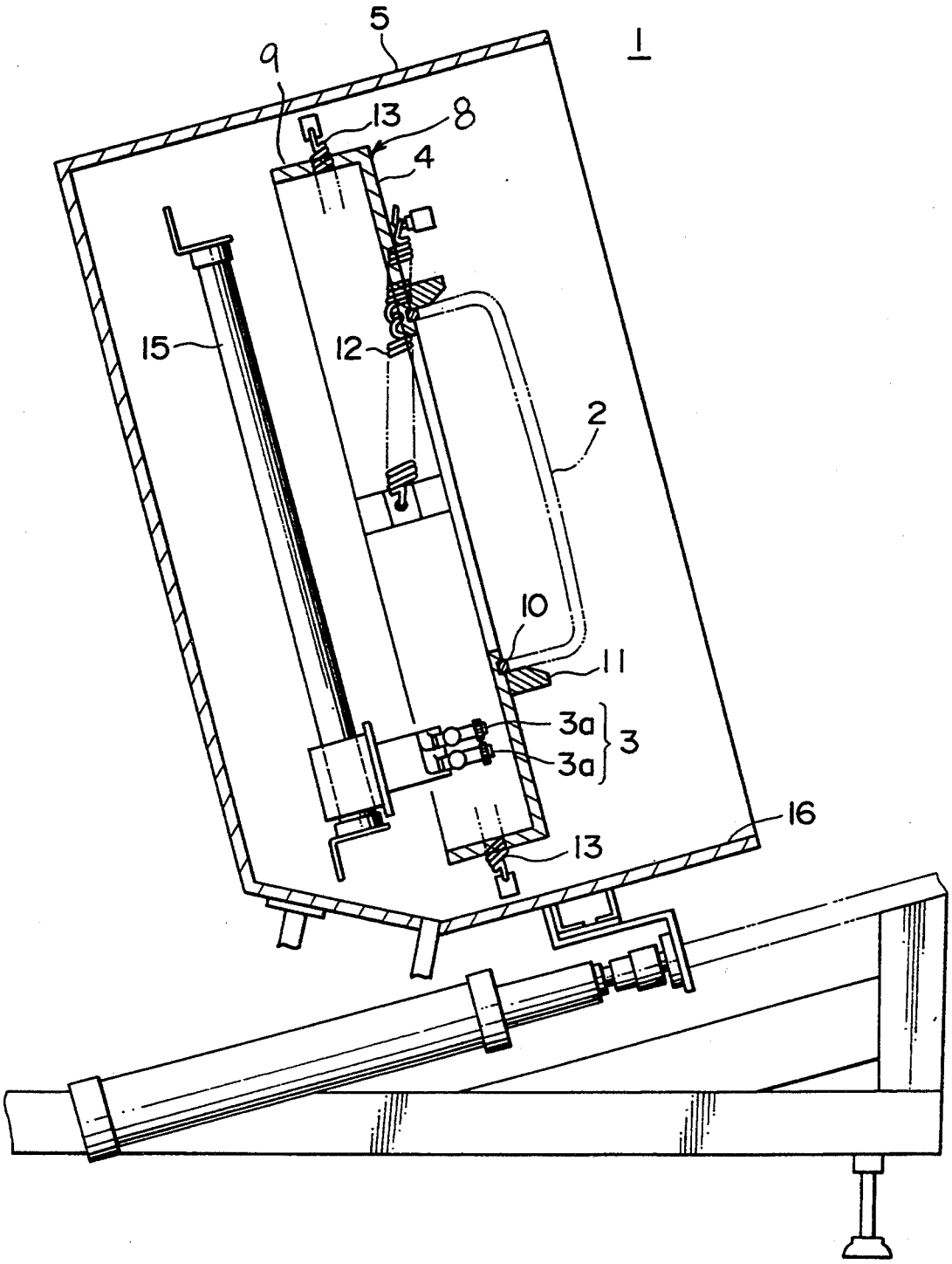
FIG. 3 is a vertical sectional view of the developing apparatus of FIG. 1.

Referring to FIGS. 1 to 3, the developing apparatus shown is generally denoted at 1 and includes a nozzle 8 for jetting water as developing liquid toward an inner face of a panel 2 fixed in position on the developing apparatus 1, a mask 4 which is contacted, upon development, closely with a seal end face of such panel 2 (that is, a frit seal face to be joined to a funnel). and a vessel 5 which surrounds, upon development, the entire panel 2.

The nozzle 3 includes a plurality of nozzle elements 3*a* disposed in two horizontal rows along leftward and rightward directions of the panel 2, that is, in a direction perpendicular to stripes of a fluorescent face over the leftward and rightward width of the panel 2. The nozzle 3 is disposed for movement in upward and downward directions of the panel 2 (in directions of the stripes of the fluorescent face) along a guide shaft 15 secured in the vessel 5.

Here, the nozzle 3 includes a plurality of, eight in the present embodiment, units of such nozzle elements 3*a*, and eight water supply ports 6 for supplying water to the nozzle 3 therethrough are provided corresponding to the eight units of the nozzle elements 3*a*.

The mask 4 has a flat face portion 8 having an area sufficiently greater than an area defined by the four sides of the panel 2 (so as to allow an end portion of the panel 2 to approach an inner wall of the vessel 5). The flat face portion 8 of the mask 4 has an opening 7 formed at the center thereof corresponding to an opening of the panel 2 and is adapted to closely contact with a seal end face 2*a* of the panel 2. The mask 4 further has a tubular portion 9 extending from an outer periphery of the flat face portion 8 remotely from the panel 2, A resilient tubular member 10 is provided at a location of the fiat face portion 8 of the mask 4 at which the mask 4 closely contacts with the seal end face 2*a* of the panel 2 in order to improve such close contact between the mask 4 and the seal end face 2*a* of the panel 2, The flat face portion 8 of the mask 4 has a positioning portion 11 provided integrally thereon for engaging an outer periphery of the panel 2, The mask 4 is supported in the vessel 5 by way of springs 12 and 13, The two springs 12 are provided to bear the weight of the mask 4 while the four springs 13 are provided at the four corners of the mask 4 to keep the mask 4 in a balanced condition. The nozzle 3 is disposed in the tubular portion 9 of the mask 4.

The vessel 5 has an opening 16 into which a panel 2 is to be inserted, and is disposed for movement along a pair of guide rails 18 which are provided in an inclined condition at a predetermined angle (at 15 degrees in the arrangement shown) on a base 17. The vessel 5 is moved by an air cylinder 19.

The developing method of the present embodiment proceeds in the following manner using the apparatus 1 described above.

First, a panel 2 after undergoing an exposure step is clamped by a clamping head of a panel clamping apparatus not shown and fixed at such a predetermined position as shown in FIG. 2 wherein an inner face thereof is directed obliquely downwardly and stripes to be developed may extend in upward and downward directions.

Figure 4:
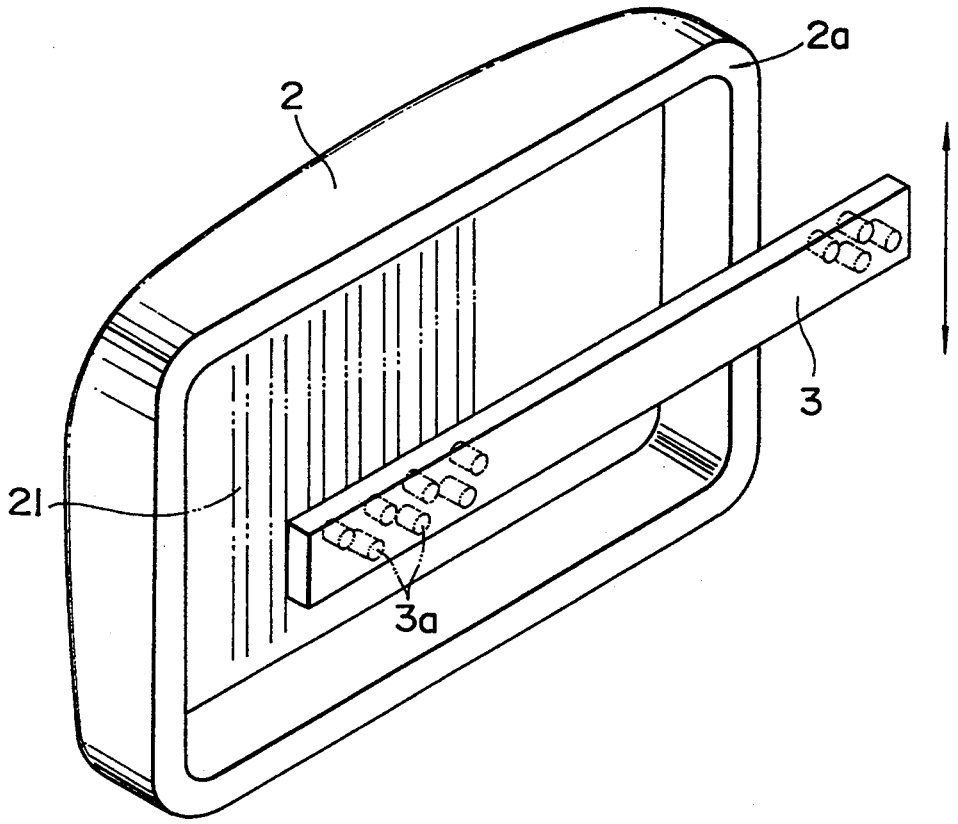
FIG. 4 is a perspective view of part of the developing apparatus of FIG. 1.

Then, the vessel B is advanced from a standby position indicated by a solid line in FIG. 2 to an operative position indicated by a chain line toward the thus fixed panel 2 by the air cylinder 19 to put the panel 2 into the vessel 5. At the chain line position of the vessel 5, a seal end face 2*a* of the panel 2 is resiliently contacted closely with the mask 4 supported on the springs 12 and 13 in the vessel 5 as shown in FIG. 3 while an outer periphery of the panel 2 is engaged with the positioning portion 11 of the mask 4 thereby to fix the position of the mask 4. In this condition, since the vessel 5 is inclined by 15 degrees by the guide rails 18, the nozzle 3 is opposed to an inner face of the inclined panel 2 such that they extend parallel to each other. Then, water as developing liquid is jetted all at once from the nozzle elements 3*a* of the nozzle 3 while the nozzle 3 is moved in the upward and downward directions along the guide shaft 15, that is, in the directions of elongate strip regions allocated on the inner face 4 stripes 21 to be developed on the inner face of the panel 2 as shown in FIG. 4 to perform a developing operation.

According to the embodiment described above, since the panel 2 is fixed and the nozzle 3 is moved toward the panel 2 together with the vessel 5 and then the nozzle 3 is moved In the directions of the stripes 21 to be developed to perform development, otherwise possible outward dispersion of water as developing liquid is restricted. Then, particularly since development is performed while the panel 2 is put in the vessel 5 and the seal end face 2*a* of the panel 2 is held in close contact with the mask 4, developing liquid is not dispersed to the outside, and consequently, otherwise possible dispersion of developing liquid around the panel 2 can be prevented with certainty. Accordingly, it can be prevented that developing liquid adheres to the panel clamping apparatus or to another panel at a following step and so forth, and the reliability of the manufacturing process is improved.

Further, since development is performed while moving the nozzle 3 in the longitudinal directions of the stripes 21, a good developing operation free from irregular development can be achieved. Accordingly, a fluorescent face of such a fine pattern as that on, for example, a high quality color cathode ray tube can be produced with a high degree of accuracy.

It is to be noted that the developing apparatus 1 described above can be used for cathode ray tubes of different types having different sizes by exchanging the mask 4.

Having now fully described the invention, it will be apparent to one of ordinary skill in the art that many changes and modifications, can be made thereto without departing from the spirit and scope of the invention as set forth herein.

What is claimed is:

1. A method of cleaning a panel in the manufacture of a cathode ray tube, a cathode ray tube of the type having a plurality of parallel color stripes of a fluorescent face formed on the inner face of the panel, comprising the steps of fixing a panel at a position, and jetting developing liquid by way of a nozzle toward an inner face of the panel while moving said nozzle in a direction corresponding to elongate strip regions allocated on the inner face for stripes of a fluorescent face to be formed on the inner face of the panel, to perform development of the panel.

2. The method according to claim 1, wherein the step of jetting developed liquid is further characterized in that a plurality of nozzles are provided for simultaneously jetting developing liquid onto the parallel strip regions allocated on the inner face of the panel while moving the plurality of nozzles in a direction along the parallel strip regions.

3. The method according to claim 2, wherein said step of jetting developing liquid is further characterized in that said developing liquid comprises water.

4. A method of cleaning an inner face of a cathode ray tube panel in the manufacture of a cathode ray tube, the cathode ray tube of the type having a plurality of parallel color stripes of a fluorescent face formed on the inner face of the panel, comprising the steps of:

holding the panel in a frame;

providing a supply of water and a plurality of nozzles flow connected to the supply of water;

arranging the nozzles in a spaced environment corresponding to elongate strip regions allocated for parallel, spaced apart color stripes to be developed on the inner front face of the panel;

jetting water from said nozzles against the inner face of the panel; and translating nozzles with respect to the panel along the longitudinal direction of said strip regions.

5. The method of claim 4 comprising the further steps of before jetting the water from said nozzles, pouring PVP photosensitive liquid onto the inner face of the panel to form a PVP photosensitive film of a uniform film thickness; and after the PVP photosensitive film is dried, exposing the film to a light using color selecting electrodes as an optical mask.

6. The method of claim 5 comprising the further steps of:

after jetting water from said nozzles against the inner face of the panel, pouring carbon slurry over the entire inner face of the panel to form a uniform applied film of carbon;

after the applied carbon film is dried, pouring a reversing agent into the panel; and using said nozzles and repeating said translating of the nozzles in a longitudinal direction of the strip regions washing the inner face of the panel with water.

7. The method of claim 6 comprising the further steps of;

pouring PVA photosensitive liquid into the panel to form a PVA photosensitive film of a uniform film thickness; and after the PVA photosensitive film is dried, exposing the panel to light, corresponding to two colors of red and blue using the color selecting electrodes as an optical mask; and washing the panel with water using the nozzles and repeating said translating of the nozzles in a longitudinal direction of the strip regions, to form resist layers at portions corresponding to the two colors of red and blue.

8. The method of claim 7 comprising the further steps of:

applying a slurry of a fluorescent substance of green to the inside surface of the panel;

after the slurry of the fluorescent substance is dried, exposing the panel from a front of the panel;

pouring a reversing agent into the panel to dissolve the resist layer; and washing the panel with water using the nozzles and repeating said translating of the nozzles in a longitudinal direction of the stripes to lift off the resist layers together with the applied fluorescent slurry films thereon to form stripes of the green fluorescent substance at positions between carbon stripes.

* * * * *